US006390148B2

(12) United States Patent
Martin

(10) Patent No.: US 6,390,148 B2
(45) **Date of Patent: *May 21, 2002**

(54) RUGGED HIGH FLOW RATE VALVE FOR BOTTLE FILLING MACHINES

(75) Inventor: Wendell S. Martin, Fort Smith, AR (US)

(73) Assignee: Anderson-Martin Machine Co., Fort Smith, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/862,640

(22) Filed: May 21, 2001

Related U.S. Application Data

(63) Continuation of application No. 09/612,183, filed on Jul. 6, 2000, now Pat. No. 6,244,309.

(51) Int. Cl.[7] ..... B65B 1/04
(52) U.S. Cl. ..... 141/39; 141/286; 141/301
(58) Field of Search ..... 141/286, 6, 31, 141/39, 40, 44, 115, 116, 311 A, 301, 302

(56) References Cited

U.S. PATENT DOCUMENTS

| | | | | |
|---|---|---|---|---|
| 4,086,943 A | 5/1978 | Fernandez | ..... | 141/39 |
| 4,089,353 A | 5/1978 | Antonelli | ..... | 141/302 |
| 4,349,055 A | 9/1982 | DiChiara | ..... | 141/39 |
| 5,060,702 A | 10/1991 | LaWarre, Sr. et al. | ..... | 141/39 |
| 5,474,113 A | 12/1995 | Rademacher et al. | ..... | 141/31 |
| 6,244,309 B1 | 6/2001 | Martin | ..... | 141/39 |

*Primary Examiner*—Steven O. Douglas
(74) *Attorney, Agent, or Firm*—Head, Johnson & Kachigian

(57) ABSTRACT

There is disclosed a filling valve for incorporation in a bottle filling machine such as the Crown bottle filling machine or other functionally similar bottle filling machine, which the filling valve has a housing adapted so that the liquid beverage will flow through the valve orifice from a reservoir and further through a bottle sealing rubber into the bottle or other container. A valve stem centrally located in the valve has a passageway extending through it which permits gas displaced from the container as it is filled to pass upward through the stem into the reservoir. A distinctive valve stem guide is provided in the housing which has a non-circular opening, preferably a generally triangular opening, which serves to restrain rotational movement of the stem by virtue of a hexagonal shape, or other polygonal shape, of the cross-section of a portion of the stem. A drip stopper in the valve includes a slidably mounted, generally conically shaped element which in its upward position obstructs the opening for liquid flow and in its lower position provides a large annular area for rapid flow of liquid. The drip stopper is urged with a modest force to an upward position by a spring that is overcome by the unbalanced pressure existing during the filling mode before the liquid in the container has reached the desired fill level.

6 Claims, 3 Drawing Sheets

RUGGED HIGH FLOW RATE VALVE FOR BOTTLE FILLING MACHINES

CROSS-REFERENCE TO RELATED APPLICATIONS

This application claims priority to and is a continuation of U.S. application Ser. No. 09/612,183, filed Jul. 6, 2000, now U.S. Pat. No. 6,244,309.

STATEMENT REGARDING FEDERALLY SPONSORED RESEARCH OR DEVELOPMENT

Not Applicable.

REFERENCE TO A MICROFICHE APPENDIX

Not Applicable.

FIELD OF THE INVENTION

The present invention relates to the field of filling containers including, but not limited to, glass and plastic bottles and cans with liquids; more particularly it relates to new rugged, durable, high flow rate filling valves for use in machinery for filling beverage containers.

BACKGROUND OF THE INVENTION

High speed automated machinery has been used and can continue to be used in modern beverage bottling plants, particularly in connection with carbonated beverages. When filling containers with carbonated beverages, the method and apparatus employed involves providing a liquid beverage and carbon dioxide under pressure in a manner that counter pressure in the container facilitates filling the containers with accurately predetermined quantities of liquid beverage. Typically, the machinery includes a rotating table which is fed by conveyors with empty containers and having eight, twelve or more filling stations each having a filling valve. The containers enter the rotating table from an entry conveyor and are filled while progressing around a table and turret. Usually there is a capping process also effectuated before the containers leave the turntable onto an exit conveyor.

The manner in which the containers are properly located at a filling station and sealing contact is made by engagement and disengagement with a bottle sealing rubber all form no part of the present invention and the details thereof are not expressly disclosed herein. Specifics of such matters are well known in the art as well as being readily available from prior patents referred to herein and which are incorporated by reference for that purpose. The specific embodiment of filling valve illustrated and described herein is particularly adapted for incorporation in a very well known beverage container filling machine, commonly referred to as a Crown filler. It will be apparent however that the principles embodied in the invention are also adaptable to filling valves for other brands and other types of beverage bottle filling machines.

Filling machinery which employs filling valves to which the invention relates customarily include a reservoir above the filling valves containing the liquid beverage which is to flow under the effect of gravity into the containers. The gas above the liquid is pressurized and normally provides the carbon dioxide carbonating gas to be used to charge the container. The tops of filling valves extend into the reservoir from below and provide conduits from the reservoir to the empty container. According to a long known and well known process, initially the gas valve of the filling device fills a container with a counter pressure gas before the bottle or the container is filled with liquid by opening the filling valve incorporated in the filling device.

As the liquid fills the container, gas in the container being displaced is evacuated through a tube incorporated in the filling valve upwardly into the gas and liquid reservoir. When the level of liquid in the container rises to the opening of the tube, the gas which previously could escape through the tube can no longer escape and gravity flow of the liquid ceases under the altered pressure relationship. Shortly thereafter, the liquid and gas valves are closed and customarily a snifter is operated designed to release the remaining excess pressure in the container before its release and departure from the filling device.

In the Crown filler and in other forms of filling machines, the valves are generally controlled and synchronized by mechanical cams or other mechanical or electrical means to control the above sequence where gas is admitted to the container for counter pressurizing the gas in the container after which the liquid flow valve is opened, the filling process is completed, the valves are closed and the pressure in the neck of the container is appropriately released by a snifter valve.

While the technique of liquid level flow in the container relying on pressure balance to terminate the flow and provide proper filling of the containers is theoretically sound and generally effective, small quantities of liquid will continue to pass into the container due to the relatively large cross-sectional area for liquid passage. A common technique to eliminate or suppress the after flow when pressure balance is produced (by the liquid rising to above the vent tube opening) has been to put a fine screen, preferably with capillary size openings, across the liquid flow path. With this arrangement, the small capillary openings in the screen operate in conjunction with the surface tension of the liquid to virtually prevent any further flow when the gas pressure below the screen comes equal to or nearly equal to the pressure of the liquid above the screen. In filling valves various forms of such screens have been proposed in various locations in the valve as is shown in various patents including U.S. Pat. No. 5,060,702 granted Oct. 29, 1991 to LaWarre Sr. et al., and U.S. Pat. No. 4,349,055 issued Sep. 14, 1982 to Dichiara. A problem with these types of assemblies is the position of the screen in the high pressure area may produce additional foaming, and in any case the screen undesirably restricts the liquid flow through the valve before the liquid rises to the desired fill level.

SUMMARY OF THE INVENTION

A filling valve according to the invention is generally functionally equivalent to filling valves in widely used and long known such machines including but not limited to Crown bottle filling machines. The filling valve is characterized by a housing of generally cylindrical form adapted so that the liquid beverage will flow therethrough from the filling machine bowl or reservoir and through a bottle sealing rubber into the bottle or other container.

The valve comprises a valve stem having a passageway extending therethrough. The valve is provided with a liquid valve seal and fluid valve spring together with conventional connections for attachment with the snift valve, the vent tube the bottle sealing rubber, etc., all of generally conventional form. The stem for the valve is distinctive and differs from the prior art in that a lower portion thereof is formed of hexagonal cross section with relatively thick walls so that the valve is more rugged and durable in operation through the many cycles that are required of it. A lower stem guide is provided for the stem which maintains its central location in the housing while permitting free movement up and down and allowing passage of liquid past the lower stem guide along the outer surface of the stem. In the preferred embodiment this is implemented by making the shape of the hole in the lower stem guide triangular there rather than hexagonal. Thereby, three faces of the hexagonal cross-section stem are closely engaged by the inside surfaces of the hole in the lower stem guide while there is an opening at each of the other three faces providing communication for liquid passage above and below the lower stem guide. This is desirable to prevent the collection of and/or gradual release of liquid above the lower stem guide to below the lower stem guide at inappropriate times. The resulting configuration provides a much more rugged mounting for the stem and also ruggedizes the stem itself so that failures of the valve due to bending or distortion of the stem are virtually eliminated. At the same time, the improved structure is not significantly more complex or difficult to produce.

Valves according to the invention also differ from the prior art in that the commonly employed liquid screen in prior filling valves for Crown fillers is eliminated and replaced by a simple but highly effective drip stop mechanism which somewhat increases the rate of flow and thus the maximum speed of operation while more positively cutting off the residual flow after the pressure has been equalized by the action of the vent tube.

All portions of the valve, to the extent feasible, are formed of corrosion resistant metal such as stainless steel. Suitable plastic materials, if available, could be utilized in place of metal. Some sealing elements are necessarily made of resilient non-metallic material.

DETAILED DESCRIPTION OF THE INVENTION

Figure 1:
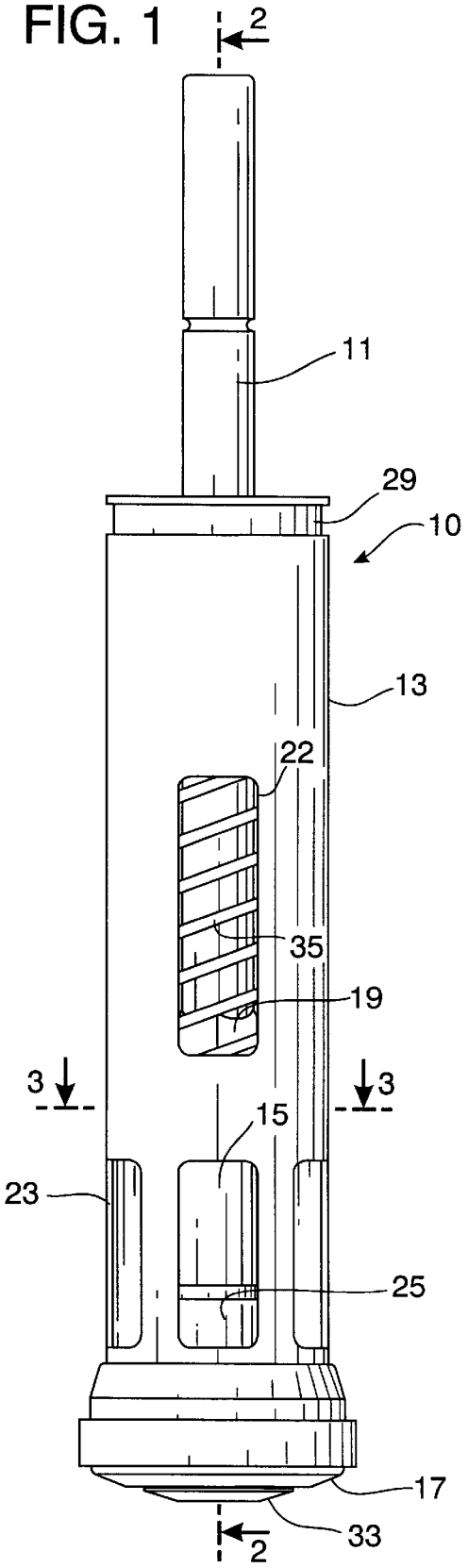
FIG. 1 is an elevational view of a filling valve according to the invention.

Referring now to the drawings and particularly FIGS. 1–4, a valve 10 according to the invention is shown including a fluid valve stem 11 centrally mounted in a housing 13 by means of a lower stem guide 15 and an upper stem guide 29. A liquid valve seal element 17 preferably formed of rubber, synthetic elastomer, or other resilient material, is secured at the lower end of the stem 11. The valve seal element 17 is shiftable up and down with respect to a valve seat (not shown) in FIGS. 1–4 for more selectively preventing and permitting flow through the filling orifice formed by the housing 13 when mounted in the bottom of a pressurized bowl or reservoir of a bottle filling machine in a customary fashion.

The environment for the valve structure shown is FIGS. 1 through 4 is well known and is not shown therein. The environment in its relation to the valve structure shown will be understood by those skilled in the art and by reference to prior art patents and to FIG. 5 showing prior art structure to be described hereinafter.

Figure 3:
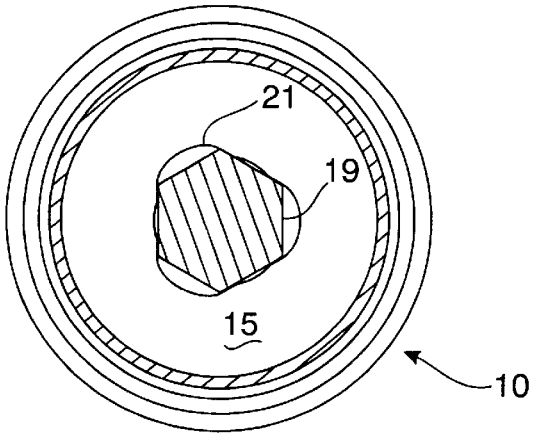
FIG. 3 is a sectional view thereof taken along the line 3—3 in FIG. 1.
Figure 4:
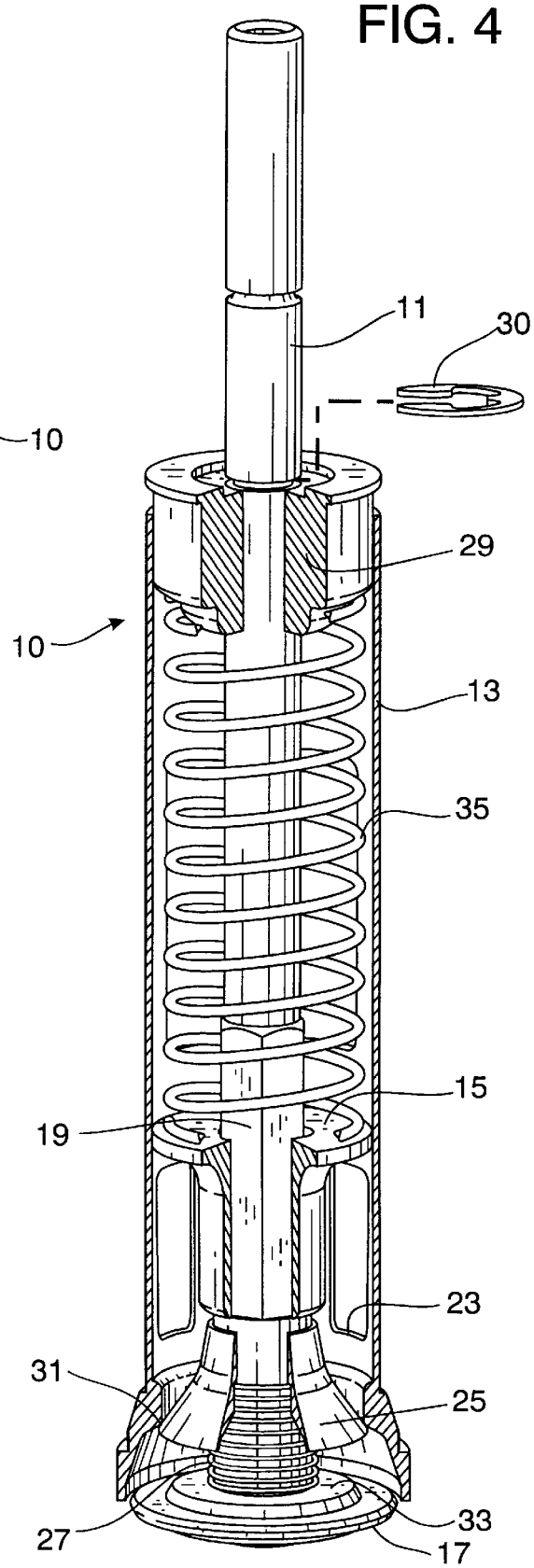
FIG. 4 is a perspective view thereof partially broken away to show the interior of the valve.
Figure 5:
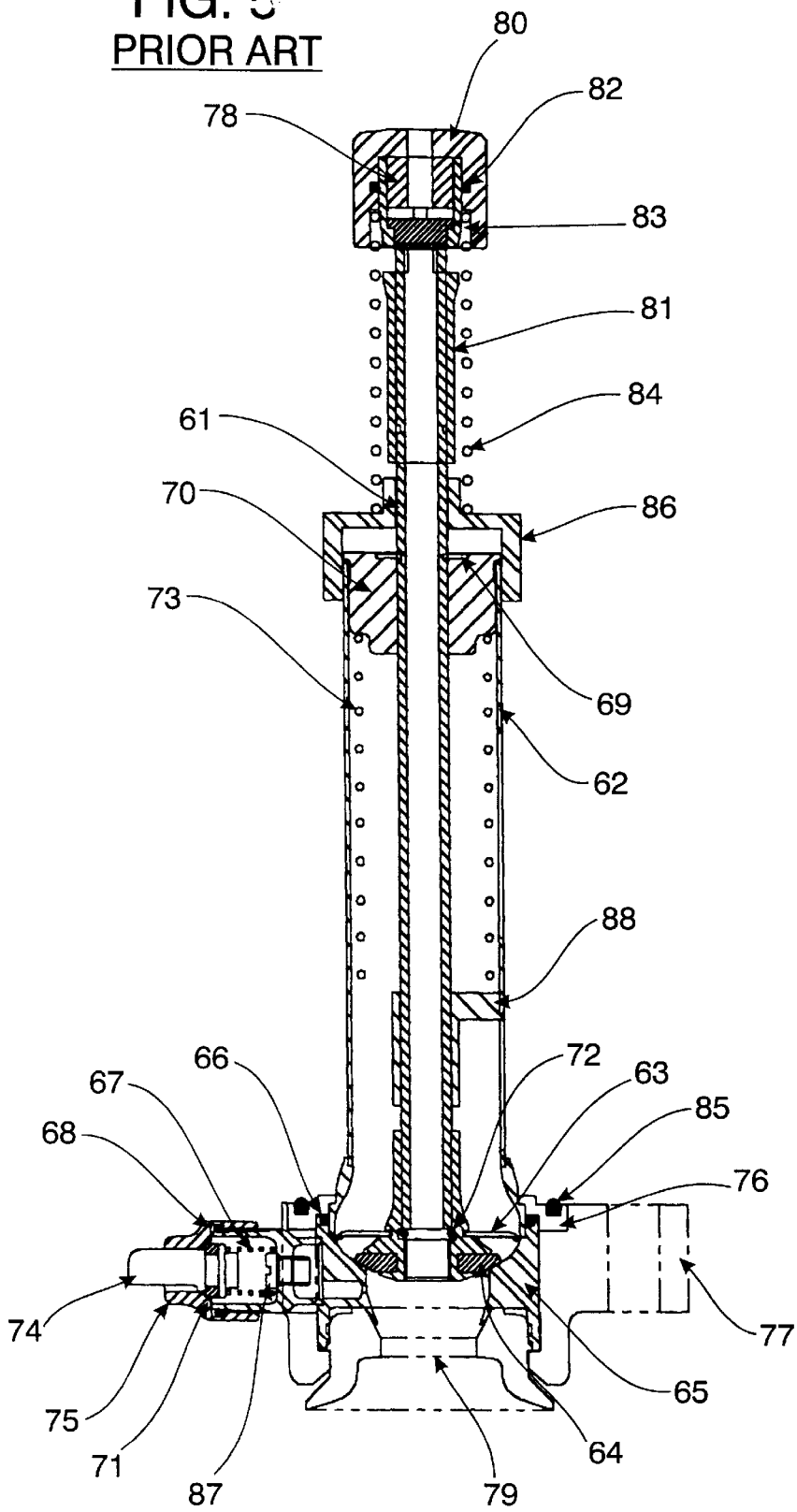
FIG. 5 PRIOR ART
FIG. 5 is a sectional view of a prior art filling valve for Crown fillers including other parts representing the environment of the filling valve.

As best seen in FIGS. 3 and 4, stem 11 on a lower portion has a hexagonal cross-section enlargement which cooperates with a generally triangular hole 21 of larger cross-sectional area; thus any rotational movement of stem 11 is constrained in a positive, rugged manner while liquid flow between the valve portion above lower stem guide 15 and below lower stem guide 15 is permitted by the spaces which occur adjacent three of the faces of the hexagonal stem portion 19. It will be noted that vertical sliding motion of stem 11 is limited in conventional fashion by stem retainer 30, as best seen in FIG. 4.

Lower stem guide 15 is secured in place by any suitable conventional means including welding, brazing, adhesives, crimping, force fitting, or the like. It would be noted that the enlargement of the hexagonal portion 19 for stem 11 together with the solid rugged configuration of lower stem guide 15 provides exceptionally firm positioning and guidance of stem 11 reducing the possibility of damage to the valve from breakage or deformation of stem 11. For convenience the outline of hole 21 may be formed as a series of circular arcs with drill, router or broaching tools. It is not required that opening 21 have a true triangular shape or straight flat faces.

Openings 22 and 23 are provided in housing 13 in a generally conventional manner to accommodate the fluid flow which is controlled by the filling valve 10. A spring 35 of generally conventional form is supported at its lower end by lower stem guide 15 and on its upper end is captured by upper stem guide 29 thereby urging stem 11 upward relative to housing 13.

Figure 2:
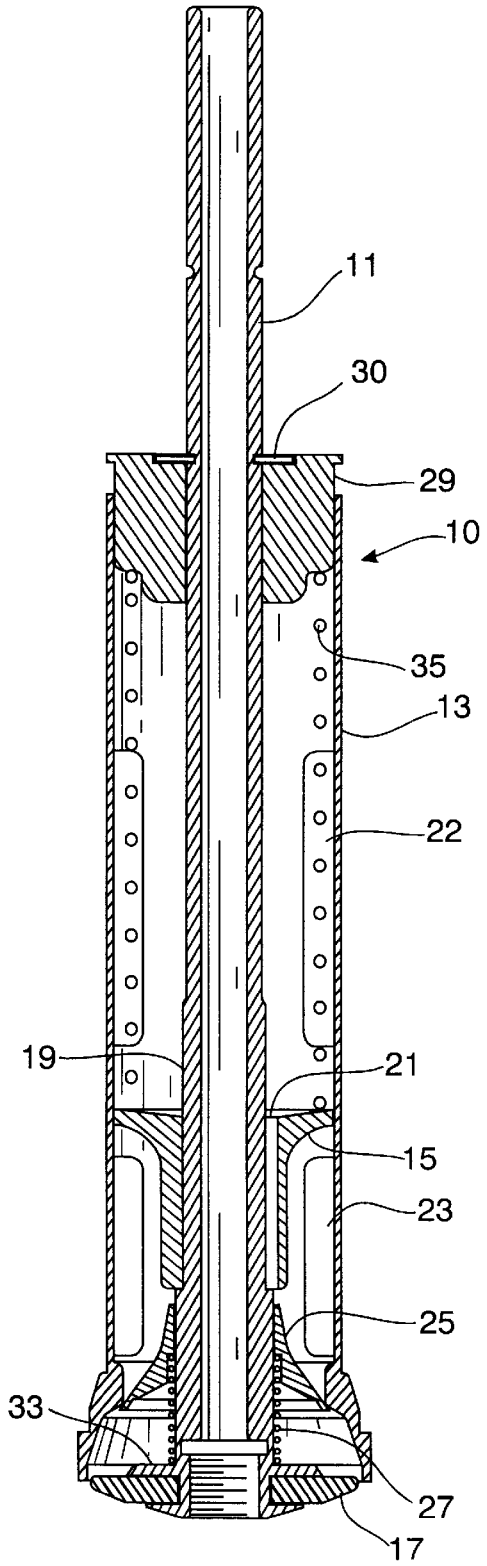
FIG. 2 is a sectional view thereof taken along the line 2—2 in FIG. 1.

It will be noted that the filling valve 10 according to the invention does not have the capillary screen commonly employed in prior art filling valves to suppress flow or drip of the liquid after pressure equalization (by operation of a vent tube). The function of the drip suppressor is performed in the filling valve 10 by drip stopper 25 and spring 27. As seen in FIG. 2 drip stopper 25 has a generally frustoconical shape and is urged upwardly by the spring 27 supported at is lower end by a flange 33 on stem 11.

When the spring 27 is allowed to extend as shown in FIG. 2, the lower peripheral portion of drip stopper 25 contacts the sides of the lower portion of housing 13 preventing the passage of small quantities or drops of liquid, under conditions of equal pressure above and below drip stopper 25. The spring constant of spring 27 is very low so that the net force urging drip stopper 25 upward at its closed position is preferably no more than about an ounce (about 28.35 grams). This force will keep the drip stopper 25 in the upward closed position while pressures are balanced above and below the drip stopper. At the same time an imbalance of force due to unbalanced pressure of liquid in the reservoir or bowl causes compression of spring 27 and substantial opening of the orifice at the bottom of housing 13 in the annular space between the peripheral edges of drip stopper 25 and the enlarged internal diameter at the bottom of housing 13. The opening provided by the downward displacement of drip stopper 25 under unbalanced liquid pressure is of substantial area and produces a rapid, very satisfactory flow rate at least as high or higher than valves with stationary capillary screens or with other such drip stop features. As mentioned elsewhere, the stem 11 is internally threaded at the bottom end to accommodate attachment of a vent tube of the appropriate length to produce the desired fill level in a container using the well known pressure balance technique.

The spring loaded drip stopper 25 has the advantage of rugged, reliable, and durable construction as compared with the capillary screen which has a much less rugged structure. The screen is subject to having its pores obstructed by solids in the liquid or deposited on the wires of the screen while the drip stopper 25 would tolerate such solids handily.

Referring now to FIG. 5, (showing a filling valve according to the prior art known as a Mark V filling valve for Crown fillers). The filling valve apparatus essentially shown in FIG. 5 is believed to be currently in use and in use from long before 1995. The advantages and improvements of the present invention will be better understood by comparison with the prior art filling valve of FIG. 5. Also the associated apparatus shown representing the environment of the filling valve (which for simplicity and clarity was not shown in FIGS. 1–4) will be useful in understanding the overall operation of a filling valve, whether that of the prior art or that of the present invention. The filling valve of FIG. 5 includes a fluid valve stem 61 centrally mounted in a housing or spring cage 62 by means of a valve stem guide 70 aided by a bracket 88. A capillary screen 63 is a prominent feature of the valve serving as a drip suppression device as previously discussed. A liquid valve seal 64 is operable to seat against a body assembly 65 when fluid valve stem 61 is depressed to its lower position (as shown in FIG. 5). In the filling process fluid valve stem 61 is at an upper position allowing fluid to flow past liquid valve seal 64 and through bottle sealing rubber 79. It will be understood that the filling valve of FIG. 5 also accommodates a vent tube secured at the bottom of fluid valve stem 61 to control the liquid level in the filling containers by the pressure balance technique.

A valve body seal 66 assures liquid tight connection between housing 62 and body assembly 65. FIG. 5 shows a conventional snift valve mechanism which is unrelated to the improvements of the present invention, but which includes a snift plunger spring 67, a snift seal 68, a snift plunger seal 71, a snift plunger 74, a snift nut 75 and a snift orifice 87.

A vent tube seal 72 insures a seal between a depending vent tube (not shown) and the interior of the fluid valve stem 61. A fluid valve spring 73 urges the valve stem guide 70 upward as well as the fluid valve stem 61 through their engagement by valve stem retainer 69.

The attachment to and mounting of filling valve housing relative to the adjacent parts is facilitated by adapter rings 76 mounting plates 77, and adapter ring seal 25.

The charging valve apparatus shown in FIG. 5 forming part of the environment of the filling valve bears no relation to the particular improvements of the present invention. Such apparatus includes a charging valve cap 80, a charging valve body 81, a retainer 82, a charging valve seal 83 a charging valve spring 84 and a charging valve spring seat 86.

Although it is believed that the operation of the filling valve according to the present invention and the significance of the improvements thereto are apparent from the foregoing description, the operation thereof will be summarized with the understanding that the apparatus forming the environment for the valve shown in FIGS. 1 through 4 will be the same or generally similar to such apparatus which is shown in FIG. 5. The manner in which containers are properly located at a filling station and sealing contact is made by engagement and disengagement with a bottle sealing rubber secured at the bottom portion of the filling valve is not related to the present invention and the details will not be discussed. It is understood that filling machinery which employs filling valves to which the invention relates customarily includes above the valves a reservoir turntable containing the liquid beverage which is to flow under the effect of gravity into the containers. Gas above the liquid is pressurized and normally provides carbon dioxide carbonating gas to be used to charge the beverage container. The filling valves 10 extend into the reservoir from below and the lower portion of the housings 13 are submerged in the liquid while the upper portion of the stems 11 surmounted by charging valve apparatus are exposed to the pressurized gas above the level of liquid in the reservoir.

In the Crown filler and in other forms of filling machines the valves, of which valve seals 17 form a part, are controlled and synchronized by mechanical cams or other mechanical or electromechanical means. The same is true of the charging valve apparatus shown in FIG. 5. Other mechanical or electromechanical operators operate the snifter valve shown in FIG. 5 to release pressure in the neck of the container in accordance with well procedures in the art.

As the liquid fills the container, gas in the container being displaced is evacuated through a vent tube and the central opening of stem 11 to the upper portion of the gas and liquid reservoir. The length of the vent tube secured at the bottom of stem 11 is selected to produce the appropriate liquid level in the particular container being filled and when the level of the liquid in the container rises to the opening of the tube, the gas which previously could escape through the tube, is blocked and gravity flow of the liquid ceases under the altered pressure relationship.

At this point it is appropriate that residual flow or drip of the liquid into the bottle be suppressed or eliminated. In the improved valve according to the invention, this function is provided by the drip stopper 25 which rode down and compressed spring 27 when the bottle was being filled due to the greater pressure from above. Once the escape of gas through the vent tube is cut off by rising liquid in the container, and pressures equalize, spring 27 forces drip stopper 25 upward to close off the orifice in housing 13. Shortly thereafter the liquid and gas valves are closed and customarily a snifter as shown in FIG. 5 is operated to release excess gas in the container before its release and departure from the filling device.

It should be understood that while only a single embodiment of the invention has been illustrated, others than the single preferred embodiment are feasible. For example, the hexagonal cross-section portion 19 of stem 11, could rather be made of octagonal cross-section and the opening 21 could then be made square so as to contact 4 of the 8 sides of that portion of the stem 11. This too would serve to restrain stem 11 from rotation while allowing apertures for liquid flow between the portions of housing 13 above and below the lower stem guide 15. In fact, other configurations readily could be devised by those skilled in the art which would be functionally equivalent to those shown or suggested herein.

The illustrated shape of the drip stopper 25 is preferred as it provides a relatively large area of opening when the drip stopper 25 is depressed while providing a more than adequate restrictive effect to prevent passage of liquid in its upward position. A resilient seal element to provide a more positive seal is optional. It should be noted that it is inherent in the operation of the device that there is no pressure differential of significance when drip stopper 25 is in its upper position and accordingly less than perfect sealing contact between the drip stopper 25 periphery and the interior of housing 13 is sufficient; surface tension and adhesion properties of the liquid will assist in preventing flow of droplets past the drip stopper 25.

The compression spring 27 surrounding stem 11 between drip stopper 25 and flange 17 is a preferred means for urging drip stopper upward with a slight well-controlled force, another arrangement utilizing a leaf spring, or utilizing an extension spring above drip stopper 25, would be feasible and functionally equivalent to that shown.

Whereas, the present invention has been described in relation to the drawings attached hereto and to modifications thereof, it should be understood that other and further modifications, apart from those shown or suggested herein, will be apparent to those skilled in the art. And are within the spirit and scope of this invention.

What is claimed is:

1. A filling valve for filling containers with liquid from a pressurized bowl, said valve comprising:

an elongated vertical housing longitudinally penetrated by a filling orifice and a stem with a gas flow conduit therethrough, said housing having an upper stem guide and a lower stem guide to limit stem movement in said housing;

said stem having a polygonal cross-section for a portion of its length and said lower stem guide has a hole with a different larger area polygonal cross-section causing said stem to be restrained from rotation relative to said lower guide and said housing while leaving a passage for liquid through said lower guide; and a liquid valve seal element arranged within said housing and shiftable on and off a valve seat for selectively preventing and permitting flow through said filling orifice.

2. A valve as recited in claim 1 further including:

a drip stop element having a generally circular cross-section and an opening therethrough mounted on a lower portion of said stem for slideable movement thereon;

a spring arranged to urge said drip stop element upward relative to said stem; and, a seat in said housing against which the periphery of said drip stop element is urged to close off low pressure liquid flow through said housing.

3. A valve as recited in claim 2 wherein said stem extends through said valve seal element and is threaded at its lower end to receive a vent tube.

4. A valve as recited in claim 3 further including a coil spring with its bottom end resting on said lower stem guide and arranged to urge said stem upwardly.

5. A valve as recited in claim 3 further including a coil spring with its bottom end resting on said lower stem guide and arranged to urge said stem upwardly.

6. A valve as recited in claim 5 wherein said stem has a hexagonal cross section and the hole in said lower stem guide is of generally triangular shape whereby only three of the hexagonal faces of said stem are contacted by the edges of said hole leaving openings adjacent the other three faces for passage of liquid through said lower stem guide.

* * * * *